United States Patent [19]

Pelly

[11] 4,084,775

[45] Apr. 18, 1978

[54] VEHICLE SEAT

[75] Inventor: Charles W. Pelly, Calabasas, Calif.

[73] Assignee: Sears Manufacturing Company, Davenport, Iowa

[21] Appl. No.: 724,164

[22] Filed: Sep. 17, 1976

[51] Int. Cl.[2] ..... A47C 7/02

[52] U.S. Cl. ..... 297/453

[58] Field of Search ..... 297/180, 453, 455, 456, 297/DIG. 1

[56] References Cited

U.S. PATENT DOCUMENTS

| | | | |
|---|---|---|---|
| 2,836,227 | 5/1958 | Swenson | 297/DIG. 1 |
| 3,341,251 | 9/1967 | Costin | 297/DIG. 1 |
| 3,485,698 | 12/1969 | Marsh | 297/452 X |
| 3,574,401 | 4/1971 | Lehner | 297/453 |
| 3,630,570 | 12/1971 | Swenson | 297/453 |
| 3,770,318 | 11/1973 | Fenton | 297/453 |

FOREIGN PATENT DOCUMENTS

| | | | |
|---|---|---|---|
| 1,292,141 | 10/1972 | United Kingdom | 297/453 |

*Primary Examiner*—James C. Mitchell

*Attorney, Agent, or Firm*—Henderson, Strom, Sturm, Cepican & Fix

[57] ABSTRACT

A vehicle seat having a seat portion for sitting upon and a back portion for resting against. Formed in the seat portion adjacent the juncture of the back and seat portions is a transverse drainage member. A horizontally disposed cross-ventilation member is formed in the back portion adjacent the juncture of the back and seat portions.

3 Claims, 6 Drawing Figures

VEHICLE SEAT

BACKGROUND OF THE INVENTION

This invention relates to vehicle seats. More specifically, this invention relates to seats for agricultural tractors, garden vehicles, construction equipment, industrial and recreational vehicles and boats. In such non-automobile applications, a seat is most commonly exposed to the elements due to the openness of the design of the vehicle to which it is applied. The seat therefore is exposed to the rain, and water can very easily collect in the seat, thereby making the operation of the vehicle extremely uncomfortable. At the very least the operator is inconvenienced by having to drain or dry the seat before resuming use of his vehicle after a rain.

A further discomfort for the operator of such vehicles is that caused by a lack of ventilation for the back. Particularly in warm weather, the sweating of the operator can cause him great discomfort.

Common expedients for increasing ventilation of the back have been employing a metal seat with a plurality of apertures formed therethrough or employing a seat with a specially woven fabric cover such that air spaces are created adjacent the back of the operator. However, the metal seats are hard and uncomfortable, and the fabric covers are somewhat expensive to make.

To provide for drainage of such seats, an aperture has been formed through the base or horizontal portion of the seat adjacent the upright or back portion of the seat. The aperture has detracted from the comfort of the operator. Furthermore, particularly in seats employing fabric or vinyl covers, metal grommets have been necessary to seal the cover to the base of the seat around the aperture. Construction of the seat has therefore been made more costly. Also, the cover of the seat has tended to tear or rip about the aperture.

SUMMARY OF THE INVENTION

A vehicle seat includes a formed base shell, a form structure and a cover member. The foam structure is placed upon the base shell, and the cover member is placed over the foam structure and sealed to the base shell. The formed vehicle seat has a substantially horizontal seat portion and an upright back portion.

A horizontally disposed cross-ventilation structure is formed in the cover member adjacent the juncture of the seat and back portions. A transverse drainage structure is formed in the cover member adjacent the juncture of the seat and back portions. A plurality of drainage grooves formed in the cover member over the seat portion communicate with the transverse drainage structure.

It is an object of this invention to provide a vehicle seat which provides effective ventilation for the back of the operator of the vehicle.

It is another object of this invention to provide a vehicle seat from which water effectively drains.

Another object of this invention is to provide a vehicle seat for non-automobile applications which greatly increases the comfort of the vehicle operator.

Still another object of this invention is to provide a vehicle seat having a cover which is durable and not prone to tearing or ripping, which is economical to construct, and which is capable of achieving the foregoing objects.

These objects and other features and advantages of the vehicle seat of this invention will become readily apparent upon referring to the following description, when taken in conjunction with the appended drawing.

BRIEF DESCRIPTION OF THE DRAWINGS

The vehicle seat of this invention is illustrated in the drawing wherein.

DESCRIPTION OF THE PREFERRED EMBODIMENT

Figure 1:
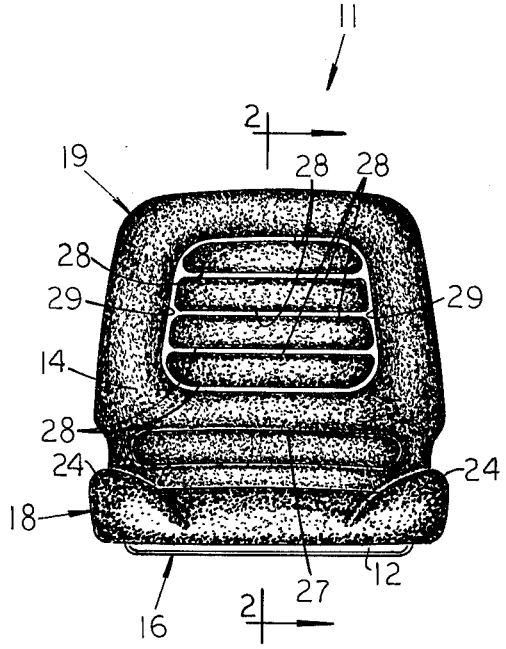
FIG. 1 is a front elevational view of the vehicle seat.
Figure 2:
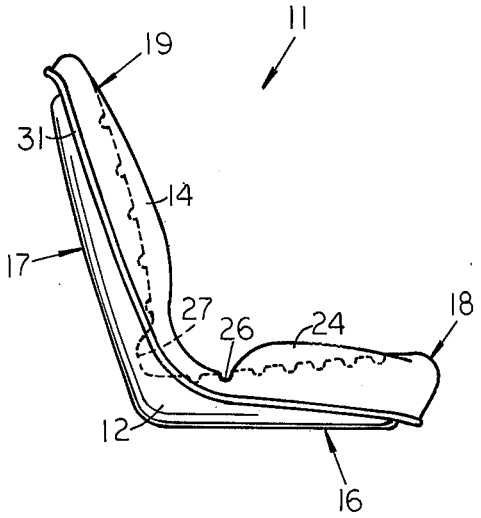
FIG. 2 is a side elevational view of the vehicle seat, dotted lines indicating the surface contour of the cover of the vehicle seat along line 2—2 in FIG. 1.

The vehicle seat of this invention is shown generally at 11 in FIGS. 1–4. The seat 11 more particularly includes a formed base shell 12, a foam layer 13 (FIGS. 5 and 6) and a cover structure 14. The base shell 12 further includes a horizontal portion 16 contiguous with a substantially upright portion 17.

The cover 14 includes a seat portion 18, which is basically horizontally disposed, and a back portion 19, which is basically upright and is contiguous with the seat portion 18. The seat portion 18 (FIG. 3) has formed therein a plurality of transverse channels 21 and a main transverse drainage channel 22. The channels 21, 22 are parallel and are interconnected at the ends thereof by longitudinal drainage channels 23. The channels 23 are formed in the seat portion 18 adjacent raised longitudinal portions 24. The portions 24 are disposed at the longitudinal edges of the seat portion 18. The main transverse drainage channel 22 communicates with the longitudinal edges of the seat portion 18 through drainage grooves 26. The grooves 26 are formed in the cover 14 adjacent the raised portions 24 and between the raised portions 24 and the juncture of the seat and back portions 18, 19.

The back portion 19 (FIG. 1) has a plurality of horizontal grooves 28 formed therein. The grooves 28 are joined at the ends thereof by grooves 29 which are basically vertically disposed. Adjacent the juncture of the seat and back portions 18, 19, a cross-ventilation pocket 27 (FIGS. 5 and 6) is formed in the back portion 19. The pocket 27 is elongated and transversely disposed.

Figure 3:
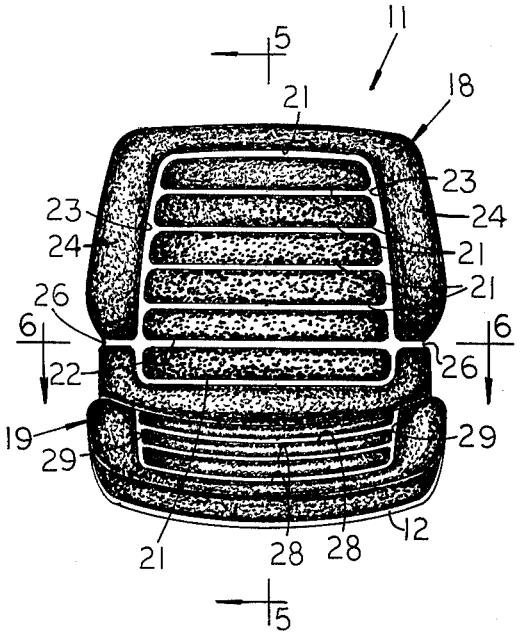
FIG. 3 is a top plan view of the vehicle seat.
Figure 4:
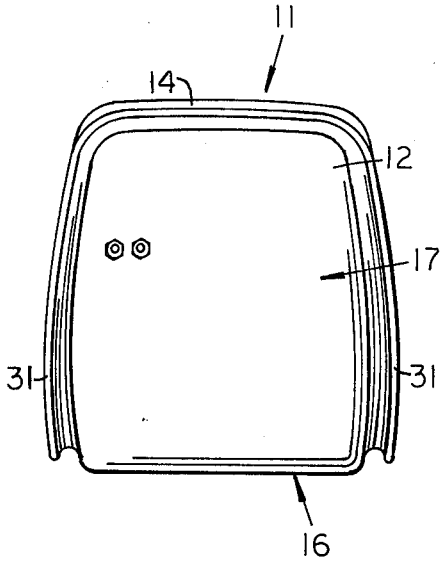
FIG. 4 is a rear elevational view of the vehicle seat.
Figure 5:
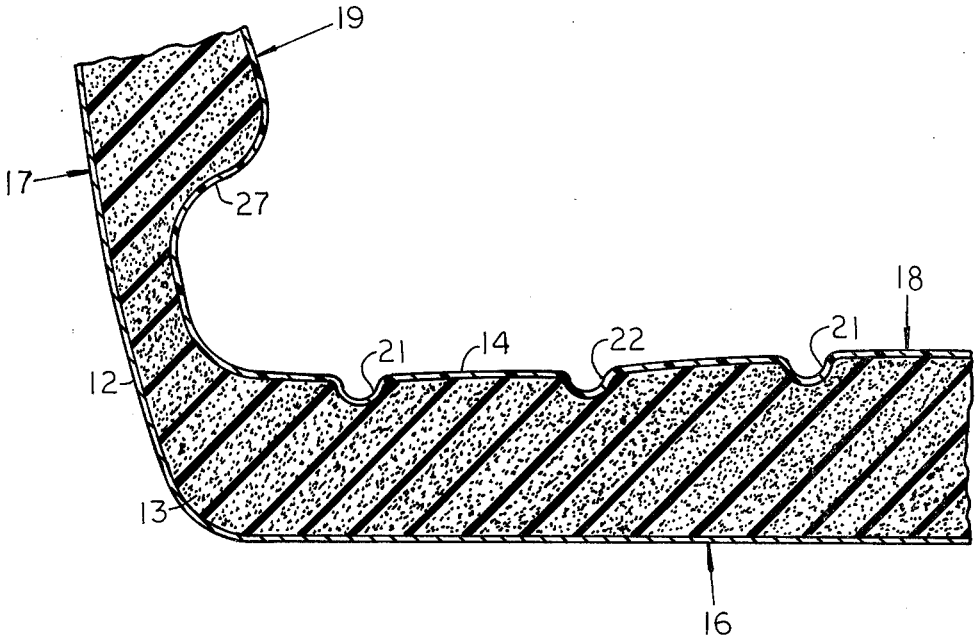
FIG. 5 is an enlarged, fragmentary longitudinal sectional view taken along line 5—5 in FIG. 4.
Figure 6:
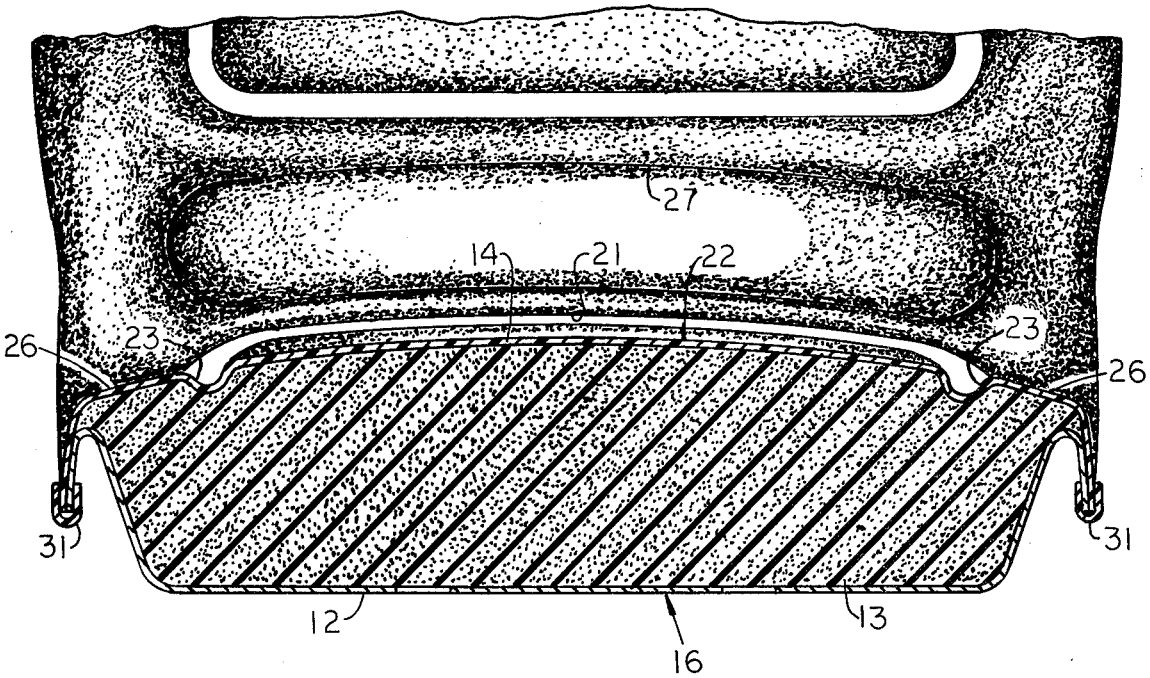
FIG. 6 is an enlarged, fragmentary transverse sectional view taken along line 6—6 in FIG. 4.

Referring now to FIGS. 3, 5 and 6, the drainage channels 21, 22 slope away from a high ridge located along the axis defined by line 5—5. The longitudinal drainage channels 23 slope downwardly toward intersections with the main transverse channel 22 at low points aligned along the axis defined by line 6—6. The drainage grooves 26 slope downwardly away from the intersection of channels 22, 23 and toward the longitudinal edges of the seat portion 18. Water, as from a rain, flows into the transverse channels 21, 22 and through the channels 23 to the intersection of channels 22, 23. The water then flows through the grooves 26, whereby the water is drained from the cover 14.

Referring again to FIGS. 5 and 6, it can be seen that the cross-ventilation pocket 27 is disposed across the small of the back of the operator. A large volume of air is thereby presented to the back of the operator, thereby greatly increasing his comfort.

The base shell 12 is a unitary structure and may be stamped out of steel of a suitable gauge. The cover 14 can be a unitary structure of molded, seamless vacuum-formed vinyl. The foam 13 may be poured into place upon the underside of the cover 14, the cover 14 being placed upon the shell 12 after the foam 13 has cooled. Alternately, a solid foam 13 may be placed upon the shell 12 and the cover 14 then placed thereover. The shell 12 and cover 14 are then sealed together about the edges 31 thereof.

It can be seen that the cross-ventilation pocket 27 provides excellent ventilation for the back of the operator of the vehicle in which the seat 11 is installed. Water is effectively drained from the seat 11 through the channels 21, 22, 23 and grooves 26. The seat 11 therefore is very effective and comfortable in non-automobile applications such as agricultural tractors, garden vehicles, construction equipment, industrial and recreational vehicles, and boats. The cover 14 is a single molded or formed piece having no apertures therethrough and requiring no grommets or similar additional pieces. The seat 11 therefore can be manufactured for less cost, and, the cover 14 not being prone to ripping or tearing, has superior durability.

Although a preferred embodiment has been disclosed herein, it is to be remembered that various modifications and alternate constructions can be made thereto without departing from the full scope of the invention, as defined in the appended claims.

I claim:

1. A vehicle seat comprising:

a base shell member having forward and upright portions;

foam means; and cover means having a seat portion and a back portion, said cover means being attached to said base shell member, said foam means being disposed between said base shell member and said cover means, said back portion being disposed over said upright portion, said seat portion being disposed over said forward portion, said seat portion having formed thereon drainage means, said back portion having formed thereon cross-ventilation means, said drainage means including a primary transverse channel, a plurality of secondary transverse channels, a pair of longitudinal connecting channels, and a pair of drainage grooves, said longitudinal connecting channels being disposed adjacent said seat portion's longitudinal edges and joining said secondary transverse channels to said primary transverse channel, said primary transverse channel at each end thereof communicating with one of said drainage grooves, said secondary transverse channels sloping downwardly toward said longitudinal connecting channels, said longitudinal connecting channels sloping downwardly toward said primary transverse channel, said primary transverse channel sloping downwardly toward said drainage grooves, each drainage groove sloping downwardly and away from said primary transverse channel and through one of said seat portion's longitudinal edges, whereby water is carried over the seat portion's longitudinal edges and off of said cover means.

2. A vehicle seat comprising:

a base shell member having forward and upright portions;

foam means; and cover means having a seat portion and a back portion, said cover means being attached to said base shell member, said foam means being disposed between said base shell member and said cover means, said back portion being disposed over said upright portion, said seat portion being disposed over said forward portion, said seat portion having formed thereon drainage means, said back portion having formed thereon cross-ventilation means, said cross-ventilation means including an elongated pocket transversely disposed and formed in said back portion, said pocket being disposed adjacent the juncture of said back and seat portions, said pocket opening substantially horizontally and outward over said seat portion.

3. A vehicle seat as defined in claim 1 and further wherein at least one secondary transverse member is disposed between said primary transverse member and said back portion.

* * * * *